United States Patent [19]

Matsuda et al.

[11] 4,432,216

[45] Feb. 21, 1984

[54] CRYOGENIC COOLING APPARATUS

[75] Inventors: Toshiharu Matsuda; Kenjiro Kasai; Seiichi Kikkawa, all of Kudamatsu; Norihide Saho, Yamaguchi; Kouzo Matumoto, Kudamatsu, all of Japan

[73] Assignee: Hitachi, Ltd., Tokyo, Japan

[21] Appl. No.: 438,464

[22] Filed: Nov. 2, 1982

[30] Foreign Application Priority Data

Nov. 6, 1981 [JP] Japan ..... 56-177195

[51] Int. Cl.[3] ..... F25B 19/00

[52] U.S. Cl. ..... 62/514 R

[58] Field of Search ..... 62/514 R

[56] References Cited

U.S. PATENT DOCUMENTS

| | | | |
|---|---|---|---|
| 3,646,775 | 3/1972 | Bonnerot et al. | 62/514 R |
| 3,882,687 | 5/1975 | Asztalos et al. | 62/514 R |
| 4,077,231 | 3/1978 | Wiebe | 62/514 R |
| 4,223,540 | 9/1980 | Longsworth | 62/514 R |
| 4,277,949 | 7/1981 | Longsworth | 62/514 R |
| 4,279,127 | 7/1981 | Longsworth | 62/514 R |

*Primary Examiner*—Ronald C. Capossela

*Attorney, Agent, or Firm*—Antonelli, Terry & Wands

[57] ABSTRACT

A split type cryogenic cooling apparatus comprising a refrigerator which permits a working gas of a high pressure and an operating temperature to generate cold heat, a cryostat accommodating a vessel containing liquefied fraction of the working gas together with an object to be cooled and a plurality of shield plates surrounding the vessel and maintained at respective temperature levels, and a communicating pipe system providing a communication between the refrigerator and the cryostat and having a vacuum heat insulation. Two or more stages of heat exchangers are disposed in the cryostat with their colder ends held in thermal contact with the shield plates and the vessel of temperature levels corresponding thereto, to thereby suppress an introduction of external heat into the cryostat.

6 Claims, 3 Drawing Figures

CRYOGENIC COOLING APPARATUS

BACKGROUND OF THE INVENTION

1. Field of the Invention

The present invention relates to a cryogenic cooling apparatus and, more particularly, to a cryogenic cooling apparatus which is suitable for use as split type cryogenic cooling system in which a refrigerator, serving as a cold heat source and a cryostat, serving as cold heat applying device, are separately installed. Still more particularly, the invention is concerned with a cryogenic cooling apparatus of the type mentioned above, wherein the cryostat has at least two stages of heat exchangers and a colder end of each heat exchanger is thermally connected to a shield plate of corresponding temperature and to a vessel, so that the heat input from the outside is reduced to permit reduction in a capacity and size of the refrigerator and also a simplification of construction of the cryogenic cooling apparatus as a whole.

2. Description of the Prior Art

Various types of cryogenic cooling apparatus which make use of helium gas as working gas have been proposed and used, and these conventional cryogenic cooling apparatus can be broadly sorted into a unit type apparatus, in which a refrigerator and a cryostat are constructed as a unit with each other, and a separate type apparatus, in which the refrigerator and the cryostat are constructed separately and connected through communication pipes. Generally, the cryogenic cooling apparatus of small capacity are constructed as the unit type apparatus, whereas, the split type apparatus find their use mainly when the capacity is comparatively large.

The cryogenic cooling apparatus of small capacity, however, suffers from a problem of heavy vibration and large noise because, in most cases, a reciprocating type expansion engine is used in the refrigerator of the cryogenic cooling apparatus of such small capacity. Therefore, in some cases, the split type construction is adopted even in the cryogenic cooling apparatus of small capacity, particularly when it is required to keep the vibration and noise away from the cryostat which serves the cold heat applying device.

FIG. 1 provides an example of a conventional split type cryogenic cooling apparatus having a refrigerator section which includes a first stage compressor 1, second stage compressor 2 and a refrigerator generally designated by the reference numeral 3, and a cryostat generally designated by the reference numeral 14. A communication pipe 26, having a number of working gas pipes, connects the refrigerator 3 and to the cryostat 14. A part of high pressure helium gas, discharged from the second stage compressor 2, is supplied through a valve mechanism 4 to a first expansion engine 5 and a second expansion engine 6 which constitute expansion means, and generates the cold heat through expansion in these engines 5, 6. The helium gas of an intermediate pressure, after the expansion, is returned to the juncture between the first stage compressor 1 and the second stage compressor 2. On the other hand, the remaining part of the helium gas discharged from the second stage compressor 2 is delivered to a first heat exchanger 9 in a cold box 13 and is cooled while flowing through the first heat exchanger 9. The remaining part of helium gas is then introduced through a helium gas pipe 37*a*, in the communication pipe system 26, into a first shield station 23 provided in the cryostat 13 to cool a first shield plate 15 connected to the first shield station 23 to thereby prevent a heat leak into the cryostat 14. The high pressure helium gas of, coming out of the first shield station 23, is introduced, through a helium gas pipe 37*b* in the communication pipe system 26, into a first cold station 7, provided on the end of the first expansion engine 5, and is cooled to lower temperature through a heat exchange in the first cold station 7. The helium gas is then delivered to and further cooled by a second heat exchanger 10 and, thereafter, introduced through a helium gas pipe 37*c*, in the communication pipe system 26, into a second shield station 24 in the cryostat 14 and cools a second shield plate 16. The high temperature helium gas coming from the second shield station 24 is then introduced through a helium gas pipe 37*d*, in the communication pipe system 26, to a second cold station 8 provided on the end of the second expansion engine 6 so as to be further cooled to lower temperature and sent to a third heat exchanger 11. The high pressure helium gas, which has been sufficiently cooled through heat exchange in the third heat exchanger 11, is introduced through a helium gas pipe 37*e*, in the communication pipe system 26, to a Joule-Thomson valve 18 in which the helium gas makes an isoenthalpic expansion through a pressure reduction. Consequently, the helium gas is partly liquefied and the liquid fraction is stored in a vessel 17. As a sufficient liquefied helium is accumulated in the vessel 17, the helium gas of low pressure and low temperature, after pressure reduction across the Joule-Thomson valve 18, is introduced into a low-pressure passage of the third heat exchanger 11 in the cold box 13 through a three-way valve 19 and a condenser heat exchanger 20 and through a helium gas pipe 37*f* in the communication pipe system 26, and is returned to the suction side of the first stage compressor 1 through the low-pressure passages of the second heat exchanger 10 and the first heat exchanger 9. Needless to say, when the helium gas flows through the low-pressure passages through the successive heat exchangers, it is heated through heat exchange with the helium gas flowing through the high-pressure passages, and finally becomes low-pressure helium gas of a substantially room temperature, before it is returned to the suction side of the first stage compressor 1.

A so-called heat pipe 25 containing a fluid which is boiled or condensed permits a heat exchange between the vessel 17 and the second shield plate 16 to promote the cooling of the vessel 17 when the temperature of the vessel 17 is higher than that of the second shield plate 16, during the cooling down, i.e. the start up of the cryogenic cooling apparatus as a whole. The heat exchange through the heat pipe 25 is stopped when the temperature of the vessel 17 has come down below the temperature of the second shield plate 16. The heat pipe in some cases is termed "thermal diode," "thermal coupling" and so forth.

The conventional cryogenic cooling apparatus of FIG. 1 suffers from the following problems. First, since the communication pipe system 26 has a large number of helium gas pipes (six pipes in the illustrated case), the invasion by heat is correspondingly increased to cause a shortage of the refrigerating power or liquefying power particularly in a cryogenic cooling apparatus of small capacity, so that a correspondingly large capacity refrigerator is required for obtaining the desired performance of the cooling apparatus. Additionally, there is a not so negligible heat input through the heat pipe 25 into the vessel 17 which constitutes a low-temperature part. Namely, since the heat pipe 25 consists of a tubular vessel containing the heat exchanging medium and permanently connects the second shield plate 16 and the vessel 17, heat is transferred inconveniently through the wall of the heat pipe 25 even after a heat exchange, through circulation of the fluid, is stopped after a cooling down of the vessel 17 to a temperature equal to that of the second shield plate 16. This phenomenon is equivalent to the heat leak into the vessel 17 which constitutes a low-temperature part of the cryogenic cooling apparatus. Thus, after the cooling of the vessel 17 down to the operating temperature, the heat pipe 25 undesirably constitutes a heat leak into the vessel 17.

SUMMARY OF THE INVENTION

The aim underlying the invention essentially resides in providing an improved cryogenic cooling apparatus which overcomes the above-described problems of the prior art.

To this end, according to the invention a split-type cryogenic cooling apparatus is provided which includes a compressor, for compressing a working gas of a low pressure to discharge the working gas of a high pressure, a refrigerator, having a cold box accommodating an expansion means through which the working gas of high pressure is expanded to generate cold heat, and a cryostat, for utilizing the cold heat generated by the refrigerator to to cool an object. The cryostat contains a vessel receiving a liquefied fraction of the working gas together with the object to be cooled, and shield plates surround the vessel in layers. A communication pipe system provides a communication between the refrigerator and the cryostat, and the cryostat accommodates heat exchangers arranged in at least two stages, with the heat exchanger of each stage having colder end which is held in thermal contact with corresponding one of the shield plates and the vessel.

DESCRIPTION OF THE PREFERRED EMBODIMENTS

Figure 1:
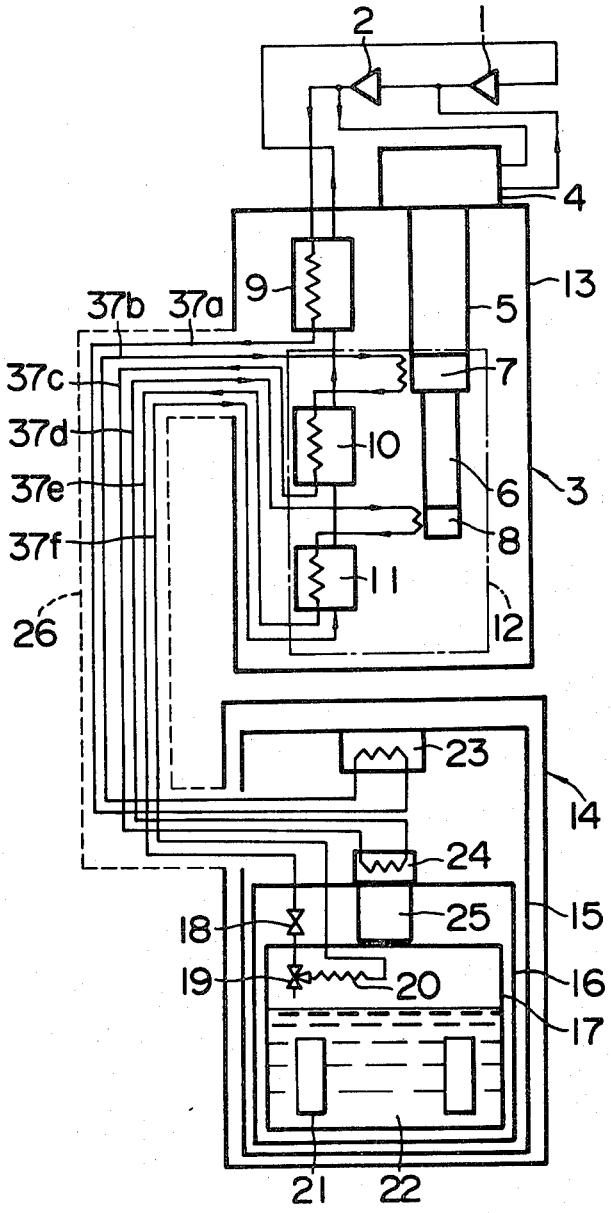
FIG. 1 PRIOR ART
FIG. 1 is a schematic view of a conventional split type cryogenic cooling apparatus.
Figure 2:
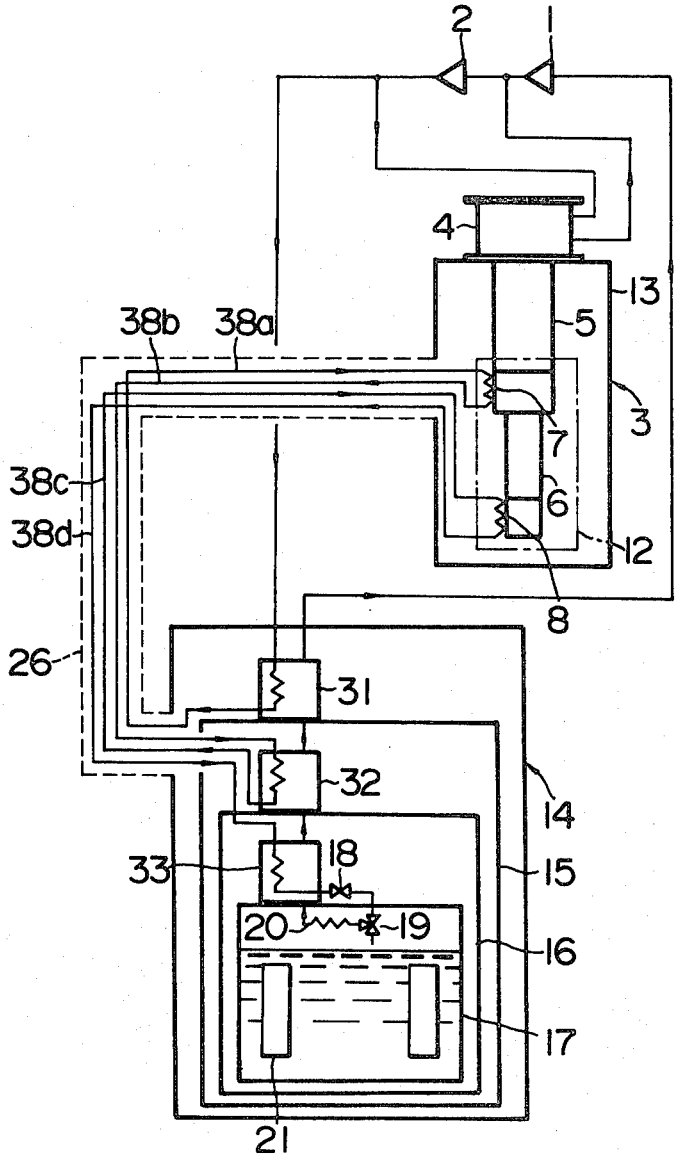
FIG. 2 is a schematic view of a split type cryogenic cooling apparatus in accordance with an embodiment of the present invention.

Referring now to the drawings wherein like reference numerals are used throughout the various views to designate like parts and, more particularly, to FIG. 2, according to this figure, a cryogenic cooling apparatus in accordance with the invention is provided wherein a part of the high pressure helium gas discharged from the second stage compressor 2 is supplied, through a valve mechanism 4, to a first expansion engine 5 and a second expansion engine 6, constituting an expansion means provided in a cold box 13. The helium gas is expanded through the expansion engines 5, 6 to generate cold heat, and is then returned to a junction between the first stage compressor 1 and the second stage compressor 2.

The remaining part of the helium gas, discharged from the second stage compressor 2, is introduced into a first heat exchanger 31 constituting a first stage of the heat exchanger accommodated by a cryostat 14. The helium gas is cooled while it flows through the first heat exchanger 31 by a heat exchange with low-pressure helium gas which also flows through the heat exchanger 31 in the counter direction, and is then delivered, through a helium gas pipe **38*a* in a communication pipe system 26 having a vacuum heat insulation, into a first cold station 7 provided on the end of the first expansion engine 5 so as to be further cooled through a heat exchange in the first cold station 7**.

According to the invention, the colder end of the first heat exchanger 31 is held in thermal contact with a first shield plate 15 of a temperature level corresponding thereto. The first shield plate 15 is cooled by the colder end of the first heat exchanger 31 to thereby prevent external heat from coming into the cryostat 14.

The high-pressure helium gas cooled by the first cold station 7 is introduced through a helium gas pipe **38*b*, in the communication pipe system 26, into a second heat exchanger 32, constituting the second stage of heat exchangers in the cryostat 14, and is cooled therein through a heat exchange with low-pressure helium gas which also flows through the heat exchanger 32 in the counter direction, and is further delivered through a helium gas pipe 38*c*, in the communication pipe system 26, to a second cold station 8 provided on the end of the second expansion engine 6 so as to be further cooled through heat exchange with the second cold station 8**.

According to the invention, the colder end of the second heat exchanger 32 is held in thermal contact with a second shield plate 16 of a temperature level corresponding thereto. The second shield plate 16, therefore, is cooled by the colder end of the second heat exchanger 32 to further reduce introduction of the external heat into the cryostat 14.

The high-pressure helium gas further cooled down by the second cold station 8 is introduced through a helium gas pipe **38*d*, in the communication pipe 26, into a third heat exchanger 33 constituting the third stage of the heat exchangers in the cryostat 14. The high-pressure helium gas sufficiently cooled by the third heat exchanger 33 makes an isoenthalpic expansion across a Joule-Thomson valve 18 to become helium gas of low pressure and low temperature, and is partly liquefied to produce a liquefied fraction which is stored in the vessel 17. The helium of low pressure and low temperature, still remaining in gaseous phase, is introduced through a condenser/heat exchanger 20 into the low-pressure passage of a third heat exchanger 33. The helium gas is then returned to the suction side of the first compressor 1 through the low-pressure passages of the second and first heat exchangers 32 and 31**.

According to the invention, the colder end of the third heat exchanger 33 is held in thermal contact with the vessel 17 of a temperature level corresponding thereto. This arrangement offers the following advantages. Namely, the vessel 17 is cooled during the cooling down, i.e. start up, at a rate which is equivalent to that performed by heat pipe conventionally used in connection with the colder end of the third heat exchanger and, more over, it is possible to prevent the undesirable introduction of external heat which inevitably takes place after the cooling down of the vessel 17 to the operating temperature in the conventional apparatus incorporating the heat pipe.

Figure 3:
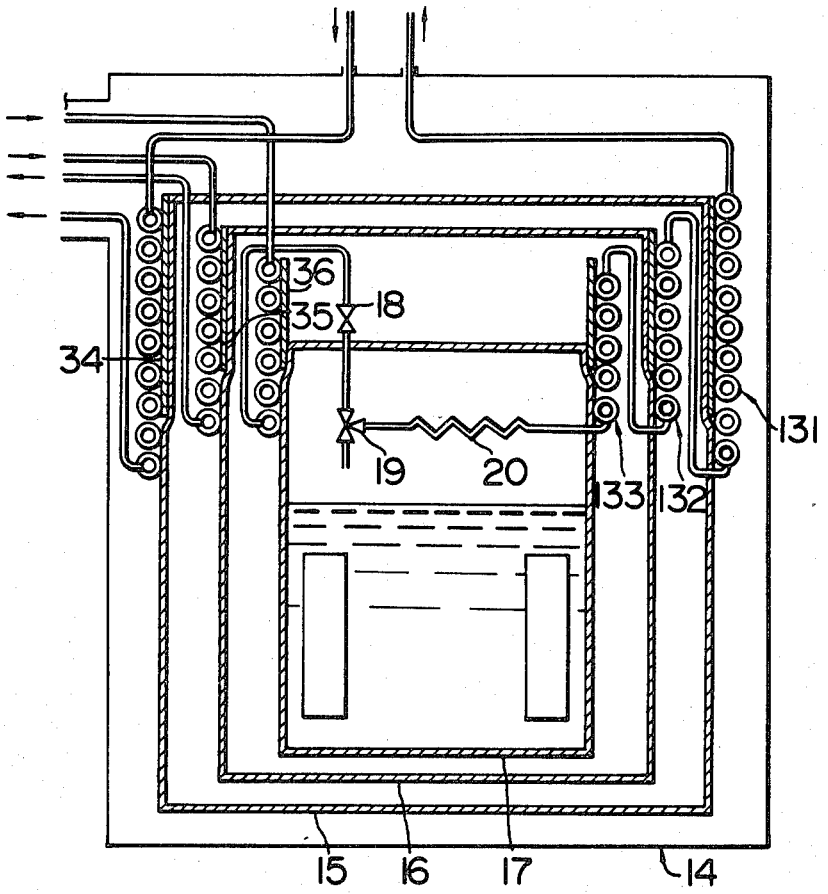
FIG. 3 is a cross sectional view of a cryostat having a plurality of heat exchanger stages, each having a double-tube type heat exchanger.

As shown in FIG. 3, a lower end, i.e. colder end, of the first heat exchanger generally designated by the reference numeral 131, which is a double-tube type heat exchanger, is held in thermal contact with the first shield plate 15 at the temperature level corresponding thereto. Additionally, a heat insulating member 34 for preventing heat exchange between the upper portion, i.e. hot portion, of the first heat exchanger 131 and the first shield plate 15 is disposed between the heat exchanger 131 and the shield plate 15. The first heat exchanger 131 is wound around the first shield plate 15 and, consequently the first heat exchanger 131 makes thermal contact with the first shield plate 15 only at the lower end thereof, so that the first shield plate 15 is cooled down to a temperature substantially equal to the colder end of the heat exchanger 131 to thereby suppress the introduction of heat to the inside of the cryostat 14. The same applies also to a second heat exchanger generally designated by the reference numeral 132 and the third heat exchanger generally designated by the reference numeral 133 both of which are also of a double-tube type construction. Namely, the heat exchangers 132, 133 only making thermal contact at their lower ends, i.e. the colder ends, with the second shield plate 16 and the vessel 17, respectively, in temperature ranges corresponding thereto. Additionally, heat insulating members 35 and 36 are respectively disposed between the upper portion, i.e. hot portion, of the second heat exchanger 132 and the second shield plate 16 and between the upper portion, i.e. hot portion, of the third heat exchanger 133 and the vessel 17, so that any heat exchange is prevented between the upper portions of the heat exchangers 132, 133 and the second shield plate 16 and the vessel 17. The second heat exchanger 132 and the third heat exchanger 133 are respectively wound around the second shield plate 16 and the vessel 17. Consequently, the second shield plate 16 is cooled down to a temperature substantially equal to that of the colder end of the second heat exchanger 132 while the vessel 17 is cooled down to a temperature substantially equal to that of the colder end of the third heat exchanger 133, to thereby effectively suppress the introduction of the external heat into the cryostat 14.

According to the invention, since the first, second and third heat exchangers 131, 132, 133 are respectively installed in the cryostat 14 with their colder ends held in thermal contact with the first shield plate 15, second shield plate 16 and the vessel 17, it is possible to reduce the number of the helium gas pipes in the communication pipe system from six to four and, hence, to reduce the diameter of the communication pipe system, so that the rate of introduction of external heat is reduced correspondingly. Particularly, the helium gas pipe between the third heat exchanger 133 and the Joule-Thomson valve 18, circulating the coldest helium gas, can be installed within the cryostat 14 so that the introduction of external heat is remarkably suppressed. Furthermore, according to the invention, the cooling down of the vessel 17 at the time of start up of the apparatus is accomplished by the third heat exchanger 133 without any assistance from a heat pipe, so that the undesirable introduction of external heat, which has been inevitable in the conventional apparatus after the cooling down of the vessel 17 to the operating temperature, is perfectly avoided. Additionally, the construction of the cyrogenic cooling apparatus as a whole can be simplified advantageously due to the elimination of the shield station and the heat pipe.

As will be fully understood from the foregoing description, due to peculiar structural features of the cryogenic cooling apparatus of the present invention, in which at least two stages of heat exchanger are disposed in the cryostat 14 with their colder ends held in thermal contact with the shield plates or vessel of corresponding temperature levels, the following advantages are offered:

(1) It is possible to use a refrigerator 14 of smaller capacity than in the conventional apparatus because the introduction of external heat through the communication pipe 26 is suppressed considerably;

(2) the introduction of external heat, which is inevitable in the conventional apparatus after the cooling down of the vessel 17 to the operating temperature, is avoided because the vessel 17 is cooled without any assistance from a heat pipe; and (3) the construction of the cryogenic cooling system as a whole can be simplified due to the elimination of necessity for shield station and heat pipe.

What is claimed is:

1. A split type cryogenic cooling apparatus comprising: compressor means for compressing a working gas of a low pressure to discharge a working gas of a high pressure; a refrigerator having an expansion means for expanding said high pressure working gas to generate cold heat; a cryostat utilizing said cold heat generated by said refrigerator to cool an object to be cooled, said cryostat containing a vessel for receiving liquified working gas together with said object to be cooled, and at least one shield plate surrounding said vessel; a communication pipe system for connecting said refrigerator and said cryostat to each other; said cryostat accommodating heat exchangers arranged in at least two stages, said heat exchangers having cold ends thereof respectively held in thermal contact with said shield plate and said vessel such that the shield and and the vessel temperatures are maintained at predetermined temperature levels substantially equal to a temperature of the respective heat exchangers.

2. A cryogenic cooling apparatus according to claim 1, wherein each of said heat exchangers are adapted to cool the high pressure working gas by a working gas of low temperature and low pressure.

3. A cryogenic cooling apparatus according to claim 1, wherein a plurality of shield plates surround said vessels and are disposed in layers, and wherein said cryostat accommodates heat exchangers in at least three stages, each of said heat exchangers having a cold end thereof respectively in thermal contact with said shield plates and said vessel.

4. A cryogenic cooling apparatus according to claim 3, wherein each of the heat exchangers includes a hot portion, and wherein insulating means are interposed between the hot portions of the respective heat exchangers and the associated shield plates or vessel whereby only the cold ends of the heat exchangers are maintained in thermal contact with the shield plates and vessel.

5. A cryogenic cooling apparatus of split type comprising: a compressor for compressing a working gas of a low pressure to discharge a working gas of high pressure; a refrigerator having a cold box accommodating an expansion means through which said working gas of high pressure is expanded to generate cold heat; a cryostat utilizing said cold heat generated by said refrigerator to cool an object to be cooled, said cryostat containing a vessel for receiving a liquified fraction of said working gas together with said object to be cooled, and shield plates surrounding said vessel in layers; a communication pipe system for providing a communication between said refrigerator and said cryostat; said cryostat accommodates heat exchangers arranged in at least two stages, said heat exchanger of each stage having a colder end which is held in thermal contact with a corresponding one of said shield plates and said vessel, said heat exchagers are double-tube type heat exchangers having colder ends held in thermal contact with said shield plates and said vessel, and wherein heat insulating members are disposed between hot portions of said double-tube type heat exchangers and said shield plates or vessel, said double-tube type heat exchangers being wound around said shield plates or said vessel.

6. A cryogenic cooling apparatus according to claim 5, wherein each of said heat exchangers comprises a double-tube type heat exchanger including an inner tube through which the high pressure working gas passes and an outer tube through which the working gas of low temperature and low pressure resulting from the expansion of the working gas of the high pressure passes, said double-tube type heat exchangers having cold ends thereof respectively in thermal contact with said shield plate and said vessel, each of said double-tube type heat exchangers including a hot portion, said cryostat further including thermal insulating means respectively disposed between said hot portions of said double-tube type heat exchangers, said shield plate, and said vessel.

* * * * *